US012012701B2

(12) United States Patent
Ponstein et al.

(10) Patent No.: US 12,012,701 B2
(45) Date of Patent: Jun. 18, 2024

(54) SELF-PROPELLED GROUND MILLING MACHINE

(71) Applicant: BOMAG GMBH, Boppard (DE)

(72) Inventors: Joachim Ponstein, Boppard (DE); Jerome Beilvert, Boppard (DE)

(73) Assignee: BOMAG GMBH, Boppard (DE)

( * ) Notice: Subject to any disclaimer, the term of this patent is extended or adjusted under 35 U.S.C. 154(b) by 0 days.

(21) Appl. No.: 17/453,739

(22) Filed: Nov. 5, 2021

(65) Prior Publication Data

US 2022/0145551 A1 May 12, 2022

(30) Foreign Application Priority Data

Nov. 6, 2020 (DE) ..... 10 2020 006 837.5

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01); *E01C 2301/30* (2013.01)

(58) Field of Classification Search
CPC ..... E01C 2301/40; E01C 23/088; E01C 23/127; E01C 2301/00; E01C 2301/30; E02F 9/0833; E02F 9/16; E02F 9/163; E02F 9/166; B62D 33/06; B62D 33/0617; B66C 13/54
See application file for complete search history.

(56) References Cited

U.S. PATENT DOCUMENTS 10,227,741 B1 * 3/2019 Husar ..... E01C 23/088
10,732,263 B2 8/2020 Sturm et al.
2005/0093282 A1 * 5/2005 Gaertner ..... E01C 23/08 404/90
2008/0258535 A1 10/2008 Berning et al.
2009/0010713 A1 * 1/2009 Kotting ..... E01C 23/088 404/128
2011/0298188 A1 12/2011 Haubrich et al.
2012/0243939 A1 * 9/2012 Oxford ..... E01C 23/088 404/90
2015/0093196 A1 4/2015 Haubrich et al.
(Continued)

FOREIGN PATENT DOCUMENTS

CN 107667047 2/2018
CN 109923265 6/2019
(Continued)

OTHER PUBLICATIONS

English language translation of Kuhn, DE-102016010660-A1, published Oct. 12, 2017 (18 pages) (Year: 2017).*
(Continued)

*Primary Examiner* — Janine M Kreck
*Assistant Examiner* — Michael A Goodwin
(74) *Attorney, Agent, or Firm* — Grossman, Tucker, Perreault & Pfleger, PLLC

(57) ABSTRACT

A self-propelled ground milling machine comprising a machine frame, a drive motor, a ground milling device having a milling drum arranged inside a milling drum box and rotatable about a horizontal rotation axis transverse to a forward traveling direction of the ground milling machine, front and rear travel devices, right and left lateral outer walls, and an operator platform.

19 Claims, 3 Drawing Sheets

(56) References Cited

U.S. PATENT DOCUMENTS

| | | | | |
|---|---|---|---|---|
| 2016/0001818 | A1* | 1/2016 | Thelen | B60R 3/02 180/69.2 |
| 2018/0223486 | A1 | 8/2018 | Anheier et al. | |
| 2019/0024328 | A1* | 1/2019 | Stahl | E01C 23/01 |
| 2020/0392678 | A1 | 12/2020 | Ponstein et al. | |

FOREIGN PATENT DOCUMENTS

| | | | | | |
|---|---|---|---|---|---|
| CN | 111593642 | A | * | 8/2020 | |
| DE | 102010050441 | | | 10/2011 | |
| DE | 102012022879 | | | 2/2014 | |
| DE | 102016010660 | | | 10/2017 | |
| DE | 102016010660 | A1 | * | 10/2017 | B62D 33/0617 |
| DE | 102016009646 | | | 2/2018 | |
| DE | 102018002170 | | | 6/2019 | |
| EP | 3078773 | | | 4/2008 | |
| EP | 2011921 | | | 6/2008 | |

OTHER PUBLICATIONS

Office Action from related Chinese Appln. No. 202111318098.1, dated Feb. 2, 2023. English translation attached.

* cited by examiner

SELF-PROPELLED GROUND MILLING MACHINE

FIELD

The invention relates to a self-propelled ground milling machine, in particular a cold type road milling machine, especially a center or rear rotor type milling machine.

BACKGROUND

Self-propelled ground milling machines are well known. A typical field of application for such machines is, for example, milling off road material during road rehabilitation works. Such machines are known, for example, from DE102012022879A1 and DE102016009646A1.

Ground milling machines of this type typically comprise a machine frame, which in particular designates the essential support structure of the machine. Further, in order to provide the drive energy required for traveling operation and, in particular, for driving a working device, a drive motor is provided, which is usually supported by the machine frame. Said drive motor is, for example, a diesel engine. The ground milling machine further comprises front and rear travel devices, for example in the form of wheels and/or crawler tracks. These may be provided as single devices or in pairs. The travel devices may be connected to the machine frame at least partially via lifting devices, such as lifting columns, such that they are adjustable in height or in vertical direction. Such a lifting device is described, for example, in DE102010050441A1. It is also possible for the working device, which will be described in more detail below, to be height-adjustable relative to the machine frame, for example by means of a swivel arm or swivel fork. For milling the underlying ground, the ground milling machine comprises a ground milling device as the working device, the essential component of which is a milling drum which can be rotated within a milling drum box and about a horizontal rotation axis extending transversely to a forward traveling direction of the ground milling machine. The milling drum is usually a hollow-cylindrical support tube with a large number of milling chisels arranged on its outer circumferential surface. In milling operation, the milling drum with its milling chisels engages the underlying ground and mills it to a desired milling depth. The specific arrangement of the ground milling device on the ground milling machine may vary. For example, so-called center rotor type milling machines are known, for example from DE102016010660A1, in which the ground milling device, viewed in the forward direction of the ground milling machine, is arranged between front and rear travel devices, spaced apart from each of them in the forward direction, usually approximately in the center of the machine. Alternatively, it is also known to arrange the ground milling device at the level of the rear travel devices as seen in the forward direction of the ground milling machine and thus between the rear travel devices, as described, for example, in DE102012022879A1. Such ground milling machines are also called rear rotor type milling machines. For the removal of the milled material produced during the milling process, generic ground milling machines may further comprise one or more conveyor belts that allow the milled material to be loaded, viewed in the forward direction, toward the front, the side or the rear, depending on the specific configuration of the machine.

The control of the ground milling machine during working and/or traveling operation is usually carried out from an operator platform, in which a machine operator can find the control elements required for operating the machine during traveling and milling operation. Typically, the operator platform is positioned at the level of the ground milling device when viewed in the forward direction of the ground milling machine, so that the machine operator located on the operator platform can see side areas to the right and left of the ground milling device from the operator platform when leaning out from the operator platform. The operator platform may be configured as a driver's cab.

A generic ground milling machine further has right and left lateral outer walls. "Outer wall" refers to the outer surface of the ground milling machine. "Lateral" in this case means the right and left sidewalls extending in the forward direction, bounded in the horizontal plane by the front wall and the rear wall of the ground milling machine. It is possible that this outer wall is at least partially formed directly and immediately by the machine frame or is constituted by corresponding covers and/or cladding elements. The important aspect here is that the outer wall or its shape restricts the operator's view of the machine environment from the operator platform, since it ultimately forms the outer surface of the machine. The forward direction usually refers to the traveling direction that the ground milling machine predominantly assumes during milling operation.

The ground milling machines described above are often comparatively large machines for which, however, it is desirable to navigate as precisely as possible in working and maneuvering processes in order to obtain satisfactory work results, prevent damage to the machine and its surroundings and, in particular, avoid personal injury. In this context, the prior art already describes measures that offer an approach to partially solve these challenges. From EP2011921A2 it is known, for example, that in order to improve maneuverability, the part of the machine frame located on the zero side is set back inward in front of the platform in the traveling direction for the vehicle driver in such a way that a recess is formed in the machine frame which runs in the vertical direction, is open toward the outside as well as downward and upward, and widens out downward and forward in the traveling direction, thus sloping downward toward the front. On the one hand, this is intended to provide a viewing channel from the operator platform at least partially onto a crawler track. At the same time, the viewing channel should be as narrow as possible so that the reduction in tank volume associated with the provision of the recess can be kept to a minimum. In order to improve visibility for the machine operator, EP3078773A1 proposes to provide video monitoring devices for monitoring the ejection of material from the transport device onto a transport vehicle and/or for monitoring the area in front of the milling drum.

However, the approaches to improving visibility provided by the prior art so far each entail disadvantages. For example, some of them require comparatively complex equipment, do not allow direct observation, and/or still fail to improve visibility in a satisfactory manner.

Against this background, it is the object of the invention to provide an approach for improving visibility on a ground milling machine from the operator platform without increasing the complexity of equipment required, in such a way that optimized visibility conditions are provided for the operator from the operator platform both for milling operation and for mere traveling operation.

SUMMARY

The object is achieved with a ground milling machine according to the independent claim. Preferred embodiments are cited in the dependent claims.

According to the invention, at least one of the two lateral outer walls has a first sidewall region arranged in front of the operator platform in the forward direction of the ground milling machine, a second sidewall region positioned in front of the first sidewall region in the working direction toward the front, and a third sidewall region positioned in front of the second sidewall region in the working direction toward the front, wherein the second sidewall region protrudes sideways in the horizontal direction and perpendicular to the forward direction of the machine relative to the first and third sidewall regions and away from a longitudinal center of the machine extending in the forward direction. Thus, a first important aspect herein is the configuration of one or both sidewalls on the right and/or left side of the ground milling machine in the working or forward direction in front of the operator platform, in particular as far as the front end of the machine. This part of the machine has said at least three successive sidewall regions, wherein a sidewall region is to be understood as a partial region which is, at least essentially, uniform in the vertical direction and in the horizontal direction. In particular, the respective sidewall regions are offset relative to each other by their spacing in the horizontal plane and perpendicular to the longitudinal center of the machine. The longitudinal center of the machine is, by definition, a vertical plane extending in the forward direction and horizontally centered between the two outermost points of the ground milling machine perpendicular to the forward direction of the machine. In other words, the longitudinal center of the machine is defined by the maximum width of the machine in the horizontal plane and perpendicular to the forward direction of the ground milling machine. It extends at least parallel to the forward direction (for straight travel) or to the longitudinal axis of the ground milling machine. It is now essential that the first sidewall region and the third sidewall region are recessed toward the longitudinal center of the machine relative to the second sidewall region. In this manner, the driver located on the operator platform has an improved view along the first sidewall region onto a part of the underlying ground, in particular onto a ground area located in front of the ground milling device in the working direction. The recessed third sidewall region, on the other hand, gives the driver an improved view of the region in front of the ground milling machine or the front wall of the ground milling machine. This facilitates maneuvering and/or control of the loading of the milled material by means of a corresponding attached conveyor belt (the attached conveyor belt is thus not regarded as part of the ground milling machine per se according to the invention). Thus, in the region in front of the operator platform in the forward direction, the ground milling machine according to the invention has two successive tapers, or tapers separated by the second sidewall region, toward the longitudinal center of the machine, which altogether allow an improved view of the surrounding area of the ground milling machine in front of the operator platform in the working direction.

A sidewall region is characterized by its inherently homogeneous configuration. All three sidewall regions extend in the direction of the longitudinal center of the machine or in the forward direction. Each sidewall region by itself may be curved, arched and/or inclined, although it is preferred if the first and/or the second and/or the third sidewall region are essentially planar and/or parallel to the vertical direction and/or parallel to the longitudinal center of the machine or extend in the forward direction of the ground milling machine. It is thus preferred if the three sidewall regions are each formed, individually or all together, as a surface lying in a plane that extends in the forward direction and in the vertical direction. This configuration represents an optimum compromise between available installation space and improved visibility.

It is further particularly preferred if the second sidewall region, in particular second sidewall regions opposite one another on both sides, forms or form the maximum width of the ground milling machine or its sidewalls in the region in front of the operator platform in the forward direction of the ground milling machine. The width designates the extension of the ground milling machine in the horizontal plane and perpendicular to the longitudinal center of the machine or forward direction. This applies in particular to the configuration of the outside of the machine, which, however, does not include the travel devices.

The first and/or the second and/or the third sidewall region may each be further configured such that they slope downward vertically in a forward direction toward the front, so that an inclined shape of the respective sidewall region(s) is obtained when viewed from the side of the ground milling machine. This may result in the sidewall regions overlapping vertically when viewed in the direction of the longitudinal center of the machine. However, it is preferred if the three sidewall regions extend vertically as seen in the direction of the longitudinal axis of the machine and do not overlap in the vertical direction. This means that the three sidewall regions are adjacent to each other when projected into a virtual plane extending in the vertical direction and in the direction of the longitudinal center of the machine or the forward direction, and are free of overlap with each other.

In order to obtain optimum visibility, it is preferred if the first and/or the second and/or the third sidewall region in the horizontal plane in a direction perpendicular to the longitudinal center of the machine are each completely free of protrusions in vertical direction. This means, in other words, that the first and/or the second and/or the third sidewall region in the vertical direction exclusively represent the maximum lateral boundary of the machine. The tapers obtained relative to the second sidewall region, which are formed by the first and third sidewall regions, are thus preferably open in the vertical upward and downward directions.

It is advantageous if the second sidewall region is narrower in the forward direction than the first and/or the third sidewall region. In particular, the second sidewall region is formed in such a way that its maximum extension in the forward direction is less than half the maximum extension of the first and/or third sidewall region in the forward direction. In this manner, the visual restriction caused by the second sidewall region protruding laterally relative to the first and/or third sidewall region is reduced to a minimum. The extension of the first and/or third sidewall region in the horizontal plane and in the direction of the longitudinal center of the machine or in the forward direction is thus preferably at least twice the maximum extension of the second sidewall region in this direction.

The first and third sidewall regions may vary with respect to their extension in the horizontal plane and in the direction of the longitudinal center of the machine, or in the forward direction, relative to one another, and it is preferred here if the extension of the first sidewall region in this direction, in particular continuously, is greater than the extension of the third sidewall region. In this manner, the narrowing of the machine obtained with the first sidewall region is greater than the narrowing obtained with the third sidewall region. As a result, the field of view of the ground area in front of the ground milling device from the operator platform can be dimensioned comparatively large, while at the same time maintaining optimized visibility of an area in front of the ground milling machine.

The travel devices of generic ground milling machines may be at least partially connected to the machine frame via vertically height-adjustable lifting devices. In this manner, it is possible to vary the height position of the machine frame relative to the underlying ground, for example, to start and stop the milling process, to compensate for inclined positions and/or to reduce rocking movements of the machine frame when running over ground obstacles, such as a milling edge. It is known to connect only the rear travel devices to the machine frame via height-adjustable lifting columns for this purpose, especially in the case of rear rotor type ground milling machines. For the center rotor type, an arrangement is usually selected in which both the front and rear travel devices are connected to the machine frame via lifting devices. This is also possible with rear rotor type milling machines. The lifting devices may be so-called lifting columns in particular. These usually have a columnar structure extending in the vertical direction along a stroke axis and may, in addition to an actuator such as a cylinder-piston unit adjustable in the vertical direction, have further guide elements, such as sleeves or the like. A lifting column is herein understood to be a unit cooperating so as to effect height adjustment, which connects a travel device to the machine frame of the ground milling machine in a height-adjustable manner. For a ground milling machine in which at least one of the front travel devices is connected to the machine frame via a height-adjustable lifting column, it is now preferred according to the invention if the lifting column is arranged at the level of the second sidewall region, as seen in the forward direction, and in particular is completely overlapped by the second sidewall region, as seen in the forward direction. Thus, if the second sidewall region and the lifting column are projected into a virtual plane extending in the forward direction and in the vertical direction, the lifting column is preferably completely overlapped by the second sidewall region in the forward direction. In this embodiment, the vertical longitudinal extension of the lifting column and its axis are thus preferably parallel to the vertical extension of the second sidewall region, which is also preferably perpendicular to the horizontal plane. This solution is advantageous in that it allows the lifting column and thus also the respective travel device to be moved further outward in the horizontal plane and perpendicular to the longitudinal center of the machine than is possible in the region of the first or third sidewall region. In other words, a comparatively wide track and thus increased stability of the ground milling machine can be realized in this manner, while at the same time maintaining the improved overview of the machine from the operator platform.

The further the lifting column is spaced from the longitudinal center of the machine in an outward direction or to the right or left side in the horizontal plane, the wider the track of the ground milling machine becomes. It is therefore also advantageous if the lifting column is positioned so far out sideways that it at least partially overlaps the first and/or the second sidewall region in the horizontal plane and perpendicular to the longitudinal center of the ground milling machine extending in the forward direction. In this case, the first and/or third sidewall region are thus offset inward in the horizontal plane toward the longitudinal center of the machine relative to the second sidewall region to such an extent that the lifting column at least partially projects beyond them sideways, but is at the same time laterally covered by the second sidewall region toward the outside. Additionally or alternatively, it is also preferred if the lifting column projects beyond the first and/or third sidewall region in the horizontal plane and perpendicular to the longitudinal center of the machine by no more than 25%, preferably by no more than 15%, of the diameter of the lifting column or its maximum extension in the horizontal plane and perpendicular to the longitudinal center of the machine.

Thus, the present invention in particular relates to the outer wall configuration of the right and/or left sidewall in the region of the ground milling machine in the forward direction in front of the operator platform. It is particularly advantageous if the first and/or the second and/or the third sidewall region are set back toward the longitudinal center of the machine relative to the maximum lateral outer boundaries of the operator platform, i.e. its maximum extension in the horizontal plane and perpendicular to the longitudinal center of the machine, in particular on both sides of the ground milling machine. In fact, it is particularly preferred if the ground milling machine is recessed toward the longitudinal center of the machine on both sides and in the entire region located in the forward direction in front of the operator platform. In the region in front of the operator platform in the forward direction, the ground milling machine thus particularly preferably has a total width narrower than the maximum width of the operator platform. The maximum width of the operator platform is in this case determined by the maximum extension of the platform in the horizontal plane and perpendicular to the longitudinal center of the machine. In particular in a case in which the entire front region, i.e. comprising in particular the first, second and third sidewall regions, of the ground milling machine is narrower than the operator platform, it is possible for the operator to look forward along both longitudinal sides of the machine in the forward direction from the operator platform in a particularly convenient manner. This includes the visible area of the respective front travel devices and, in particular, a significantly improved field of vision in the region of a loading conveyor belt projecting forward from the ground milling machine.

When maneuvering the ground milling machine, it may often be advantageous if the operator on the operator platform can directly see the respective outer end face of one of the front travel devices, for example, in order to be able to maneuver precisely past ground obstacles and/or to facilitate observation of the loading process of milled material from the operator platform. For this reason, it is also preferred if the ground milling machine is configured in such a way that at least one of the front travel devices protrudes with its outer end face perpendicular to the longitudinal direction of the machine beyond the first and/or the second and/or the third sidewall region. Thus, the respective front travel device projects beyond the first and/or the second and/or the third sidewall region in the horizontal plane and perpendicular to the longitudinal center of the machine and is accordingly offset further toward the outside. Ideally, this allows the driver to view the complete outer end face of the respective front travel devices directly from the operator platform. The outer end face in this case refers to a planar virtual surface extending in the vertical direction and in the forward direction, which is formed by or surrounded by the outer side(s) of the travel element(s). It is particularly advantageous if two front travel devices are provided, which are positioned such that they each protrude with their outer end face, in the horizontal plane and perpendicular to the longitudinal center of the machine, beyond the first and/or the second and/or the third sidewall region of one of the two sides of the ground milling machine. In other words, it is thus advantageous if the ground milling machine has respective first, second and third sidewall regions on both sides and a respective front travel device is provided on both sides, which protrudes over the respective first and/or second and/or third sidewall region in each case. It is further preferred if the ground milling machine is configured such that the entire region of the ground milling machine located in the forward direction in front of the operator platform is set back toward the longitudinal center of the machine relative to the lateral outer boundaries of the operator platform. This enables overall optimized visibility on both sides of the machine.

A relatively wide track of the ground milling machine may already be obtained if the second sidewall region projects beyond an outer end face of one of the front travel devices in the horizontal plane and perpendicular to the longitudinal direction of the machine. In this case, however, it is preferred if the outer end face of these front travel devices then at least projects beyond the first and/or third sidewall region in the horizontal plane and perpendicular to the longitudinal direction of the machine or is offset further outward away from the longitudinal center of the machine. In this embodiment, the outer end face of the respective travel devices is thus located, as seen in the horizontal plane and perpendicular to the longitudinal center of the machine, between the second sidewall region and the first and/or third sidewall region. In this manner, slightly more installation space is gained, particularly in the region of the second sidewall region, which may be used, for example, to increase the volume of a water tank. At the same time, this only marginally affects the advantageous visibility from the operator platform.

The positioning of the first, second and third sidewall regions in the forward direction of the ground milling machine may also vary. However, it is advantageous if the first and/or the second and/or the third sidewall region extend, in the horizontal plane and perpendicular to the longitudinal center of the machine extending in the forward direction, at the level of a front travel device, in particular if the respective travel device is a crawler track. In this embodiment, the longitudinal extension of the travel device thus extends to such an extent that, viewed in the longitudinal direction of the machine in the horizontal plane and perpendicular to the longitudinal center of the machine, the travel device respectively overlaps, preferably simultaneously, with the first, second and third sidewall regions. In other words, the first, second and third sidewall regions each lie at least partially in the region of the longitudinal extension of the travel device in the forward direction.

Generally, it is possible for the second sidewall region to be directly adjacent to the first sidewall region and for the third sidewall region to be directly adjacent to the second sidewall region as viewed in the direction of the longitudinal center of the machine, and for the transitions between the individual sidewall regions to be correspondingly abrupt. However, it is preferred if the transition from the first to the second sidewall region and/or the transition from the second to the third sidewall region are formed by oblique surfaces running at an angle to the longitudinal direction of the machine. In this embodiment of the invention, there is thus no abrupt change between the individual sidewall regions as seen in the direction of the longitudinal center of the machine, but instead there is a transition region extending at least partially in the direction of the longitudinal center of the machine, which is in particular also configured as a transition sidewall element. For this purpose, it is also envisaged that the first sidewall region is spaced apart from the second sidewall region and/or the second sidewall region is spaced apart from the third sidewall region, as seen in the forward direction, and that they are thus in fact not directly adjacent to one another in this direction. The transition sidewall element compensates for the different positioning of the first and second and third sidewall regions in the horizontal plane and perpendicular to the longitudinal center of the machine, or perpendicular to the forward direction, and for the offset in the forward direction with a transition surface that preferably runs obliquely to the longitudinal center of the machine in the horizontal plane and parallel to the first and/or or second and/or third sidewall region in the vertical direction. They are thus in particular oblique walls running in the horizontal plane, in particular linearly, between the first and the second and/or the second and the third sidewall regions, which are particularly preferably likewise configured as planar surfaces. The inclination in the horizontal plane, when viewed in the direction of the longitudinal center of the machine toward the front, between the first and second sidewall regions is configured such that the transition sidewall is inclined outward from the longitudinal center of the machine when viewed in the forward direction, and is tilted toward the longitudinal center of the machine, when viewed in the forward direction, from the second sidewall region to the third sidewall region. In this manner, visually soft transitions are obtained between the individual sidewall regions, which are advantageous from an aesthetic point of view, for example.

The transition regions described above, or their oblique surfaces, preferably have an extension in the longitudinal direction of the machine which is smaller than the extension of the first and/or second and/or third sidewall region. In particular, the longitudinal extension of these transition regions in the horizontal plane in the direction of the longitudinal center of the machine is in the range of less than 50%, and in particular in the range of less than 25%, of the maximum extension of the first and/or second and/or third sidewall region in this direction. Additionally or alternatively, the angle of inclination of the transition region relative to the longitudinal center of the machine in the horizontal plane is preferably in the range of less than 60°, very particularly less than 50°.

It is advantageous if the ground milling machine is configured such that the right and/or left (with respect to the forward direction) sidewall in the region in front of the operator platform in the forward direction consists exclusively of the first, second and third sidewall regions, preferably with a respective transition region between the sidewall regions. Inclined surfaces which are to be attributed to the top side of the ground milling machine in the sense of a cover are not understood as a sidewall region in the present context.

It is preferred if both lateral outer walls of the ground milling machine, i.e. its left side and its right side, have first, second and third sidewall regions as described above. In this regard, it is particularly preferred if the first and/or second and/or third sidewall regions are mirror-symmetrical to each other. The longitudinal center of the machine does not necessarily have to extend in the then existing mirror plane between the right and left sides of the ground milling machine, although this is possible.

It is optimal if, in addition to the visibility-optimized configuration of one or both sidewalls in the manner described above, there is also a visibility-optimized configuration of the top side of the machine, in particular in the region of the ground milling machine from the operator platform to the front end. In this regard, it is now advantageous to have a cover wall extending in the forward direction toward the front from the operator platform and sloping downward in the forward direction toward the front. The downward slope of the cover wall in the forward direction preferably extends to the front end of the machine. The cover wall thus represents the top side of the ground milling machine, in particular in the region in front of the operator platform in the forward direction, and comprises all cover parts visible in a top view from above the ground milling machine. This means that the vertical height of the ground milling machine, at least with regard to its outer cladding, preferably decreases in the forward direction from the operator platform to the front end of the machine, so that the operator located on the operator platform also has a better view, at least in part, of the region in front of the ground milling machine. This may exclude a material transfer region in which an apparatus for material transfer toward an attached conveyor belt is provided. In this case, however, the cover wall sloping vertically in the forward direction may then extend to the front end of the machine at least on both sides of this raised area. Obviously, the outer cladding also does not include more or less punctually projecting functional elements whose main task is not to cover the ground milling machine or to shield it from the outside environment, such as a projecting exhaust pipe, mirrors, other display elements, etc.

The configuration of the cover wall may be further optimized such that, at the level of the first and/or the second and/or the third sidewall region, the cover wall slopes downward in the forward direction toward the front and/or slopes sideways at least partially in the direction transversely away from the longitudinal center of the machine. In this manner, the cover wall is also connected to the individual sidewall regions via inclined surfaces which are configured to slope outward or sideways from the top of the cover wall at least partially in the vertical plane and perpendicular to the longitudinal center of the machine.

Advantageously, the ground milling machine comprises a water tank in the region of the first and/or second and/or third sidewall region as viewed in the forward direction of the ground milling machine. Carrying water, for example, makes it possible to minimize dust generation in the ongoing milling process and/or to cool the milling drum. Although the ground milling machine according to the above embodiments is preferably narrower than the operator platform in the entire region located in front of the operator platform in the forward direction, it has been shown that the installation space available for the water tank in this region allows a sufficiently dimensioned water volume to be carried along. Additionally or alternatively, in the region of the first and/or second and/or third sidewall region, a transport conveyor belt may be provided running essentially inside the ground milling machine, which enables the transport of milled material from the milling drum box in the forward direction toward the front, for example onto an attached conveyor belt.

BRIEF DESCRIPTION OF THE DRAWINGS

The invention will be explained in more detail below by reference to an embodiment example shown in the figures. In the schematic figures.

DETAILED DESCRIPTION

Figure 1:
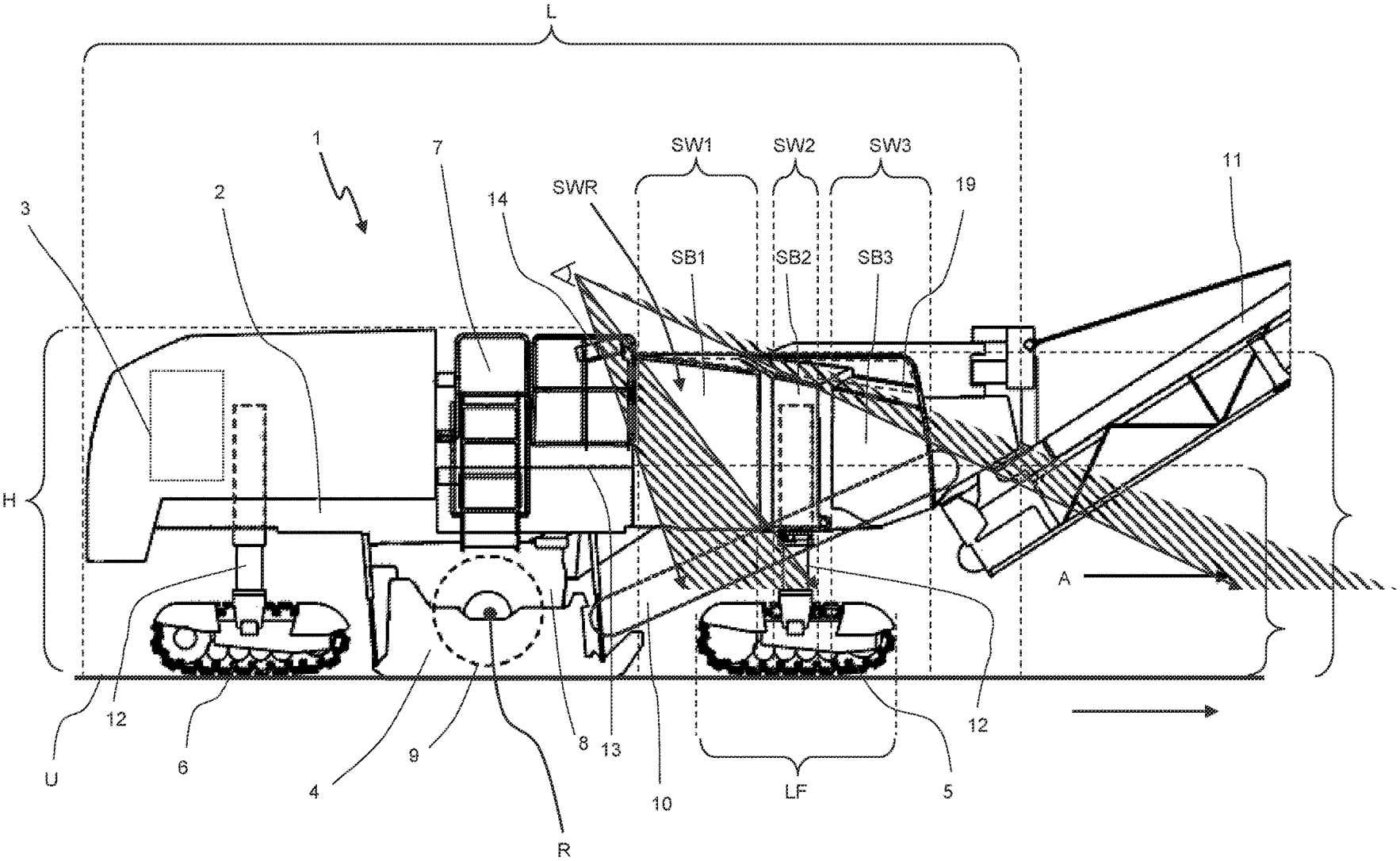
FIG. 1 is a side view of an embodiment example of a ground milling machine.

Like components are designated by like reference numerals in the figures, although not each recurring component is necessarily designated separately in each figure.

FIG. 1 shows a side view of a ground milling machine 1, more specifically the right side of the machine relative to the forward direction A. The essential elements of the ground milling machine 1 are a machine frame 2, a drive motor 3, a ground milling device 4, front travel devices 5, rear travel devices 6 and an operator platform 7. The ground milling device comprises a milling drum box 8, inside which a milling drum 9 (indicated by dashed lines in FIG. 1) is provided. The latter may comprise a hollow-cylindrical support tube with a plurality of milling tools arranged on its outer circumferential surface. The milling drum 9 rotates about a horizontal rotation axis R extending transversely to the forward direction A. In milling operation, the milling drum 9 engages the underlying ground and mills off ground material. The resulting milled material is collected in the milling drum box 8 and can then be loaded via transport devices 10 and 11, for example onto a transport vehicle. The transport device 10 is an internal conveyor belt, whereas the transport device 11 is a so-called external or attached conveyor belt. The external conveyor belt 11 is not referred to herein as part of the ground milling machine 1 per se, particularly in connection with the dimensional details of individual machine sections described in more detail below. The embodiment example shown in the figures shows a ground milling machine 1 in which the ground milling device 4 is arranged between the front travel devices 5 and the rear travel devices 6, as seen in the forward direction A. However, the invention also extends to such ground milling machines in which the ground milling device 4 is arranged at the level of the rear travel devices, as seen in the forward direction A, as is the case with so-called rear rotor type milling machines.

The travel devices 5 and/or 6 may be connected to the machine frame 2 via lifting devices, such as, for example, lifting columns 12 in this case. By adjusting the height of the lifting columns 12, the vertical distance of the machine frame and thus, for example, the depth of immersion of the milling drum 9 into the ground may be varied. In the present case, all of the front and rear travel devices 5/6 are each connected to the machine frame 2 via such a lifting column 12. Embodiments in which only the front or only the rear travel devices are connected to the machine frame via corresponding lifting columns are also possible.

The drive energy required to operate the ground milling machine 1 is provided by the drive motor 3. The latter may be located in the rear of the machine, as shown, for example, in FIG. 1. The ground milling machine 1 may further comprise a water tank 18 (indicated in FIG. 2). Said tank may be accommodated in particular in the front region or in the machine section located in front of the operator platform 7 as seen in the forward direction A. The internal conveyor belt 10, for example, may also run at least partially through this region.

The ground milling machine 1 is steered and operated from the operator platform 7. The operator platform 7 includes a floor area 13 and various control units 14. Irrespective of the specific embodiment example, it is preferred if the operator platform floor is arranged at a height of at least 1.9 m, in particular 2.0 m, and very particularly at least 2.1 m. The distance refers to a positioning of the machine with the milling drum resting on unmilled ground. The operator platform 7 may further comprise a roof and/or a cabin, as well as other elements, such as railings, a seat, etc. During traveling and milling operation, the machine operator is located in the area of the operator platform 7 and can control the main machine functions from there, such as traveling operation, operation of the ground milling device 4, the lifting columns 12 and the transport devices 10 and 11. As will be described in more detail below, it is advantageous if, in the region in front of the operator platform 7 in the forward direction A, the ground milling machine 1 is recessed toward the longitudinal center M of the machine with respect to the maximum lateral extension BF of the operator platform 7. Ground milling machines with a laterally displaceable and/or partially laterally extendable operator platform are known. In this case, the following information on the dimensions of the ground milling machine 1 refers to the center position of the operator platform and/or to the operator platform with its subelements maximally retracted toward the longitudinal center of the machine. However, it is preferred if the operator platform as a whole is stationary relative to the machine frame 2 (except for any damping devices that may be present) or comprises side elements that can be at most partially extended laterally, as described, for example, in DE102018002170A1. One of the advantages of the invention is that a laterally adjustable operator platform and/or laterally extendable operator platform elements can be dispensed with, while at the same time improving visibility.

During milling operation, the ground milling machine 1 usually moves in forward direction A, so that this direction can also be referred to as the working direction. The machine operator must now be able to navigate the comparatively large ground milling machine 1 safely and precisely from the operator platform 7 and at the same time avoid collisions of the ground milling machine, for example with a transport vehicle, surrounding obstacles and/or in particular with persons located next to or in front of the ground milling machine. A good overview of the area surrounding the ground milling machine 1, in particular in the forward direction A in front of the operator platform 7, is therefore advantageous. In this context, machine operators often find it advantageous over camera monitoring options if they can view critical machine sections directly from the operator platform 7 and do not have to rely on an indirect reproduction of an image captured by a camera on a screen.

To facilitate this, in the region in front of the operator platform 7 in forward direction A, the ground milling machine 1 is configured such that the machine operator has optimized, direct line of sight visibility from the operator platform 7 both of at least one of the front travel devices 5 and of a region in front of the ground milling machine in forward direction A. For further explanation of these special features, the configuration of the frame and the dimensioning of individual regions will first be described in more detail based on FIGS. 1 to 3.

The ground milling machine 1 has a maximum length L. The latter is determined in a virtual horizontal plane and indicates the maximum extension of the ground milling machine 1 in a horizontal plane in forward direction A. All subsequent length specifications also relate to dimension specifications in a virtual horizontal plane parallel to the length L of the ground milling machine 1. It is important to note that an attached conveyor belt that may be present, such as the external conveyor belt 11, as well as its removable fastening elements, are not included in this length L of the ground milling machine 1. What is relevant here is thus in particular the stationary entirety of the ground milling machine 1 relative to the machine frame 2.

The ground milling machine 1 further has a maximum vertical height H or a maximum height extension H. Said height is determined along a vertical line extending perpendicular to a horizontal plane from the ground on which the ground milling machine rests with the travel devices 5 and 6 to the highest point of the ground milling machine 1 in the vertical direction. In the present case, this point is formed by the rear section of the ground milling machine 1, as shown in FIG. 1. By definition, in order to determine the maximum height H, the ground milling machine is lowered to the ground using lifting devices that may be present until the milling drum 9 rests on the unmilled underlying ground U. All further height specifications below are likewise determined from the underlying ground in vertical direction and thus parallel to the determination of the maximum vertical height H. An operator platform or cabin roof is not taken into account in this case, although the ground milling machine 1 may well have such devices.

Finally, the ground milling machine 1 has a maximum width B. The maximum width B of the ground milling machine 1 is determined in a virtual horizontal plane and perpendicular to the forward direction A, as shown, for example, in FIG. 2. The maximum width is thus formed by maximally spaced points in the horizontal plane on both sides of the ground milling machine 1 along a horizontal connection line extending transversely to the forward direction A. For this purpose, the entire machine is projected into this virtual horizontal plane. By definition, the maximum width B is likewise determined based on the entirety stationary relative to the machine frame 2 of the ground milling machine 1, in particular including the milling drum box 8 of the ground milling device 4. All of the following width specifications also run in a horizontal plane parallel to the maximum width B of the ground milling machine 1 or in the virtual horizontal plane.

Figure 2:
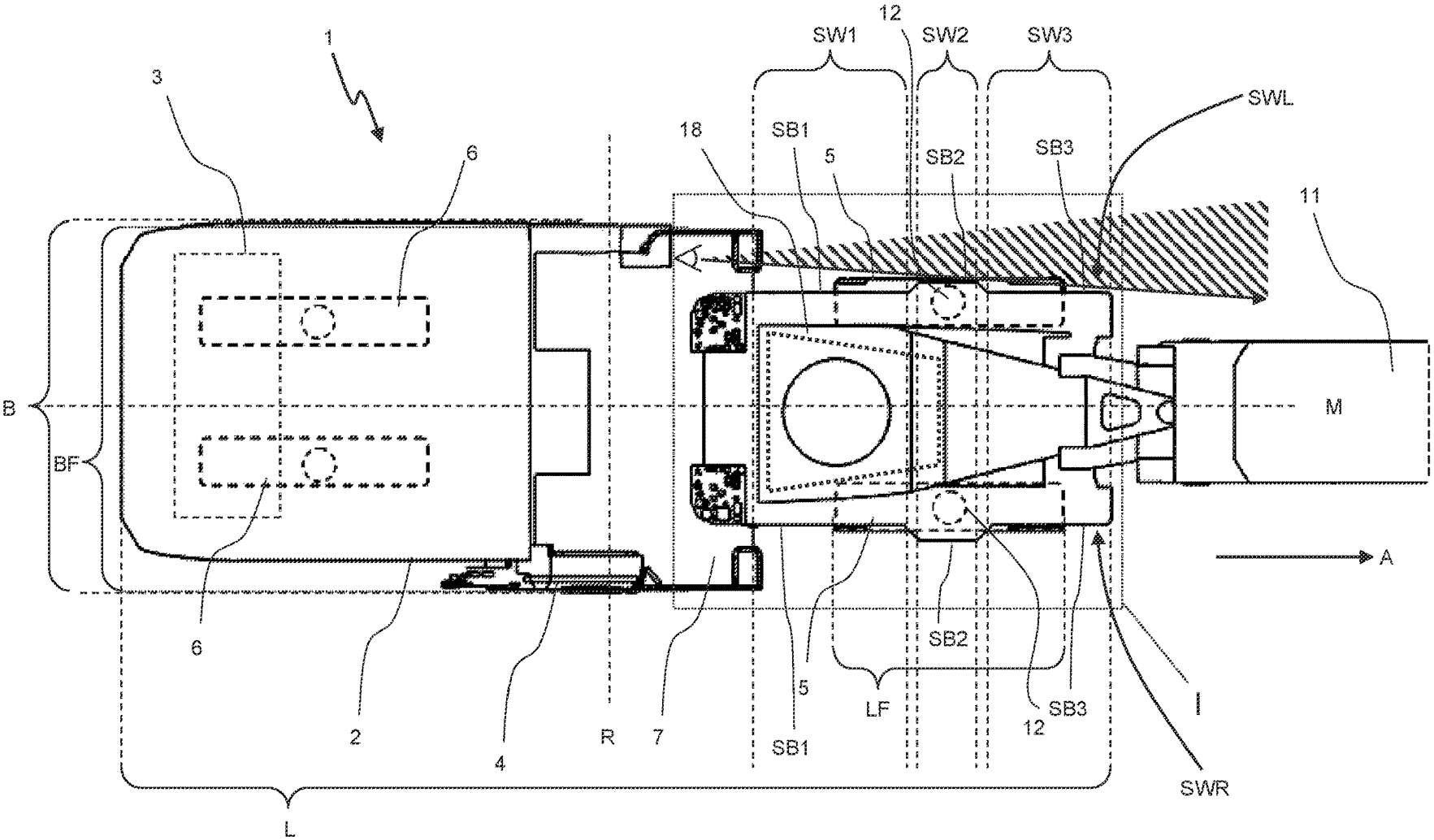
FIG. 2 is a top view of the ground milling machine of FIG. 1.
Figure 3:
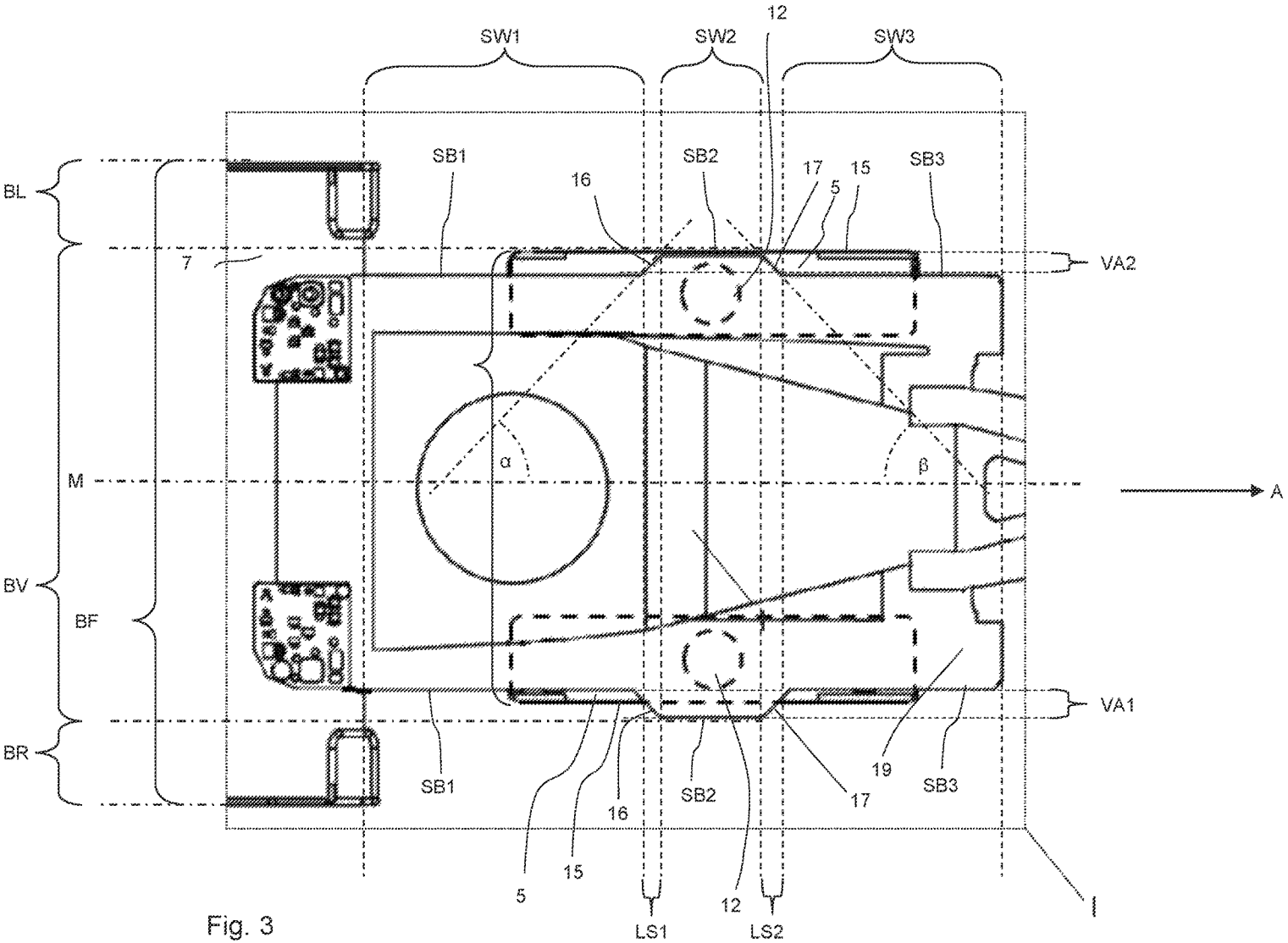
FIG. 3 is an enlarged cut-out view of region I of FIG. 2.

What is now essential is the configuration of at least one, preferably both, sidewalls SWR (sidewall on the right-hand side of the ground milling machine 1 as viewed in forward direction A) and SWL (sidewall on the left-hand side of the ground milling machine 1 as viewed in forward direction A) of the ground milling machine 1 in accordance with FIGS. 1, 2 and 3 in the region in front of the operator platform 7 as viewed in forward direction A. A sidewall SWR/SWL in the present case designates that vertically extending part of the lateral outer surface of the machine which extends in forward direction A on the right (right sidewall SWR) or on the left (left sidewall SWL) in the horizontal plane and thus delimits the ground milling machine 1 to the right or left side. It is now envisaged that the sidewall (right and/or left) of the ground milling machine 1 comprises a first sidewall region SB1, a second sidewall region SB2, and a third sidewall region SB3, which are arranged successively in forward direction A. Each of the sidewall regions SB1, SB2 and SB3 is in this case defined by an inherently uniform configuration, in particular in the vertical direction and/or horizontal direction, in particular as an inherently planar outer surface with, in particular, a surface extending in the vertical direction and parallel to the forward direction. The difference with regard to the specific configuration and position of these three sidewall regions SB1, SB2 and SB3 consists, in addition to their respective specific surface area, in particular in their spacing in the horizontal plane and perpendicular to forward direction A of the ground milling machine 1 toward its longitudinal center M. The longitudinal center of the machine is a plane extending in the vertical direction and in forward direction A and passing through the center of the maximum width B of the ground milling machine 1. This center of the maximum width B is determined by the midpoint of a virtual connection line extending in a horizontal plane and perpendicular to the forward direction A in a region having the largest width of the ground milling machine with respect to its lateral outer dimensions.

This is illustrated in FIG. 2, where the reference sign of the maximum width B is located on said midpoint. What is now essential is that the second sidewall region SB2 protrudes outward horizontally and perpendicular to the forward direction A with respect to the first sidewall region SB1 and the third sidewall region SB3, more specifically by the distance VA1 (on the right side of the machine) or VA2 (on the left side of the machine), as indicated in FIG. 3. The second sidewall region is thus offset further outward to the side of the ground milling machine 1 by the distances VA1 and VA2, respectively. At the same time, all three sidewall regions SB1, SB2 and SB3 are set back in the horizontal plane toward the longitudinal center M of the machine with respect to the respective lateral outer edge on the right or left side of the operator platform 7. As shown in FIGS. 1 to 3, this may be the case on both sides, i.e. on the right and on the left side as seen in forward direction A from the operator platform 7. The ground milling machine is thus configured such that its entire machine section in front of the operator platform 7 in the forward direction A is tapered toward the longitudinal center M of the machine on both sides with respect to the operator platform 7, and the operator platform 7 thus projects beyond this front machine section in the horizontal plane with respect to its width on both sides. In particular, the second sidewall region SB2 therefore protrudes laterally beyond the two sidewall regions SB1 and SB3, but does not project beyond the operator platform 7 in this direction. This enables the optimized visibility explained in more detail below. Further, the three sidewall regions SB1, SB2 and SB3, or SW1, SW2 and SW3, are arranged successively as viewed in the traveling direction.

On the respective side, right and/or left, the machine part formed by the sidewall regions SB1, SB2 and SB3 in the forward direction A in front of the operator platform 7 is thus narrower than the operator platform 7 in terms of extension in the horizontal plane and perpendicular to the longitudinal center M of the machine. This may be achieved in that, as shown in FIGS. 1 to 3, the respective sidewall is recessed toward the longitudinal center M of the machine on both sides, i.e. on the right and on the left side as seen from the operator platform 7 in forward direction A. The operator platform 7 has a width BF. This creates an observation clearance on both sides of the ground milling machine 1 as seen from the operator platform 7 in forward direction A, through which the operator located on the operator platform 7 has free view sideways along the ground milling machine 1 in forward direction A along the respective sidewall to the front and onto the underlying ground. The fact that the first sidewall region SB1, which is located between the operator platform 7 and the second sidewall region SB2 as seen in the forward direction A, is set back further inward toward the longitudinal center of the machine than the second sidewall region SB2 means that the machine operator standing on the operator platform 7 now has even further improved visibility in this region along the first sidewall region SB1 and down to the underlying ground U. Sidewall region SB3, which follows in forward direction A and is likewise set back relative to sidewall region SB2 projecting outward sideways, likewise creates a another narrowing of the lateral outer surface of the machine. The third sidewall region SB3 in this case extends in particular to the front end of the ground milling machine 1. In this manner, the machine operator located on the operator platform 7 can look over the upper edge of the second sidewall region SB2 and/or past the longitudinal edge of the second sidewall region SB2 at an angle and, in particular, have a better view of the region in front of the ground milling machine 1 in the forward direction A. This concerns in particular the material transfer region to an external conveyor belt 11 as well as the region between the front of the ground milling machine 1 and the external conveyor belt 11.

To illustrate the optimized viewing conditions obtained by the special configuration of the three sidewall regions SB1, SB2 and SB3, FIG. 1 shows parts of viewing axes and fields of view (hatched areas), which indicate now possible viewing perspectives of the machine operator standing on the operator platform 7. One field of view extends through sidewall region SB1 (shown in FIG. 1), which is set back toward the longitudinal center of the machine, and extends from the operator platform 7 to the underlying ground U. This region is relevant in that it is located directly in front of the ground milling device 4 following in working operation and also encompasses almost the entire extension LF in forward direction A of the front travel devices 5 located on the side of sidewall region SB1. It is thus also advantageous if the first sidewall region extends at least far enough from the operator platform 7 in forward direction A that the operator located on the operator platform 7, for example in a sitting and/or standing operating position, can see at least the ground region extending along the respective front travel devices, on which the travel device currently rests, and/or the outer end face of the respective front travel device. This corresponds approximately to length LF. The outer end face of the respective front travel device comprises the outer surface of the respective travel device extending horizontally and perpendicular to the longitudinal center M of the machine. This facilitates navigation to the extent that the machine operator located on the operator platform 7 can directly and immediately see the steering position and the ground area next to the front travel devices 5 (and partly, as shown in FIG. 2, also the ground area directly in front of the respective travel device) from the operator platform 7.

Another field of view extends beyond the sidewall region SB2 protruding sideways and sweeps over the third sidewall region SB3 located in front of it in forward direction A. This field of view is open in vertical upward direction, and it is the lower delimitation that is of particular importance in this case. It can be seen that the configuration of the third sidewall region SB3, which is set back toward the longitudinal center of the machine, gives the machine operator located on the operator platform 7 a better view of the area in front of the ground milling machine 1.

However, the arrangement discussed above not only improves the visibility in the vertical direction, but also in the horizontal direction from the operator platform 7 in forward direction A. This is exemplified in FIG. 2 for the left side of the ground milling machine 1 by the shaded background field of view, but may also be applied to the right side in the same manner, since in the present embodiment example both the right and left sides of the ground milling machine 1 each comprise a first sidewall region SB1, a second sidewall region SB2 and a third sidewall region SB3 in the manner described above. The top view of FIG. 2 shows that the maximum width BF of the operator platform 7 is significantly greater than the maximum width BV (FIG. 3) of the ground milling machine in the region in front of the operator platform in forward direction A, which comprises the sidewall regions SB1, SB2 and SB3. In the horizontal plane and perpendicular to forward direction A, the width BF of the operator platform 7 laterally protrudes on the left side by the width BL beyond the sidewall protruding maximally sideways through the sidewall region SB2 (the front travel device 5 is excluded from this consideration), and laterally protrudes on the right side by the width BR, likewise formed by the sidewall region SB2 located on the opposite right side of the ground milling machine 1, beyond the width BV of the region of the ground milling machine 1 located in front of the operator platform 7 in forward direction A. If the driver is now standing on the operator platform 7 (or its floor) on the right or (as indicated by the eye in FIG. 2) left side, a field of view opens up to him on the one hand in forward direction A along the sidewall regions SB1 to SB3 of the respective side. However, since the sidewall region SB3 is recessed toward the longitudinal center M of the machine relative to the preceding sidewall region SB2 with respect to the operator platform 7, the operator's field of view also extends forward in the forward direction A and diagonally toward the longitudinal center M of the machine. In this manner, the machine operator can in particular also directly view an area in front of the ground milling machine 1 from the operator platform 7, and in particular, for example, more reliably perceive persons in front of or close to the ground milling machine 1 in the front region, for example, at the level of the external conveyor belt 11.

It is preferred if the second sidewall region SB2, i.e. the sidewall region which protrudes perpendicular to the longitudinal center of the machine by a distance VA1 or VA2 (FIG. 3) beyond the first sidewall region SB2 preceding in forward direction A and beyond the third sidewall region SB3 succeeding in forward direction A, is located at the height of a lifting device, in this case a lifting column 12, and thus has a longitudinal extension parallel to the latter in the vertical direction. This not only enables an efficient arrangement of the lifting device in terms of installation space, but also facilitates the comparatively wide spacing of the two front travel devices 5 in order to obtain a wide track in this area. On the one hand, this increases the stability of the ground milling machine 1. On the other hand, it is then also possible for the respective front travel devices 5 to protrude in the horizontal plane with their outer end face 15 beyond at least the first sidewall region SB1 and/or the third sidewall region SB3, as shown, for example, in FIG. 3 on the right-hand side of the ground milling machine 1. In the horizontal plane, the end face 15 of the travel device may thus lie between the first and third sidewall regions SB1/SB3 and the second sidewall region SB2 as seen perpendicular to forward direction A. It is also possible for the lifting column 12 and thus the respective front travel devices to be positioned so far out sideways that the front travel devices 5 even protrude beyond the second sidewall region SB2, as shown in FIG. 3 on the left-hand side. This means that the driver located on the operator platform 7 can directly and immediately see the respective end face of the front travel devices 5 over practically their entire length in the forward direction A, at least in the ground contact area, which additionally facilitates maneuvering.

It is possible that the transition between the individual sidewall regions SB1, SB2 and SB3, viewed in the forward direction A, is abrupt and that they thus immediately follow one another. Preferably, however, the first sidewall region SB1 and the second sidewall region SB2 are connected to each other via an inclined surface 16. The inclined surface extends in the horizontal plane from the first sidewall region at an angle $\alpha$ to the second sidewall region in forward direction A and away from the longitudinal center M of the machine. Similarly, the transition from the second sidewall region SB2 to the third sidewall region SB3 is preferably obtained via an inclined surface 17, which, however, extends in forward direction A from the second sidewall region SB2 obliquely toward the longitudinal center M, in this case inclined in the horizontal plane toward the longitudinal center of the machine at an angle $\beta$. The inclined surfaces 16 and 17 may be configured as planar, essentially quadrangular surface elements. However, it is also possible to make the inclined surfaces curved or in a comparable way to obtain a visually smooth transition between the individual sidewall regions SB1, SB2 and SB3. In the horizontal plane, the inclined surfaces 16 and 17 have an extension LS1 and LS2 in the forward direction A (FIG. 3). Said extension is significantly smaller than the respective extensions of sidewall regions SB1, SB2 and SB3 (indicated as SW1, SW2 and SW3 in FIG. 1). The sidewall regions SB1, SB2 and SB3 preferably have extensions SW1, SW2 and SW3 corresponding to at least twice, preferably at least three times and very particularly at least four times the extensions LS1 and LS2.

In particular, the enlarged cut-out view according to FIG. 3 of area I of FIG. 2 makes it clear that the sidewall of the ground milling machine 1 in the machine part in front of the operator platform in forward direction A is formed exclusively by the sidewall regions SB1, LS1, SB2, LS2 and SB3, in this case in direct succession. The first sidewall region SB1 thus extends from the operator platform 7 preferably to the level of the respective front travel devices 5. The second sidewall region SB2 preferably extends completely at the level of the front travel devices 5, and the third sidewall region SB3 preferably extends from a start at the level of the front travel device 5, as seen in the forward direction A, to the front end of the machine. Thus, in other words, due to the third sidewall region SB3, a recess open toward the front in forward direction A of the ground milling machine 1 is preferably obtained.

Depending on the specific configuration of the ground milling machine 1, it may be advantageous for the water tank 18 arranged inside the ground milling machine 1 in the region in front of the operator platform 7 in forward direction A to be arranged at the level of the first sidewall region SB1 and/or the second sidewall region SB2 and/or the third sidewall region SB3.

In particular, FIG. 3 further illustrates that the first sidewall regions SB1 of both sides and the third sidewall regions SB3 of both sides are each located within the track of the two front travel devices 5. The second sidewall region SB2, on the other hand, may be located within the track of the two front travel devices 5, as is the case for the second sidewall region SB2 on the left side, or may project beyond the track toward the outside, as is the case for the right side of the ground milling machine 1 in the present embodiment example.

The ground milling machine 1 further comprises a cover wall 19 in the region in front of the operator platform 7 in forward direction A. The cover wall 19 covers this region of the ground milling machine in vertical upward direction. In forward direction A, at least in its side regions, preferably also in its central region, it is configured to slope downward toward the ground, i.e. configured to slope downward toward the ground in forward direction A at least in its side regions, which likewise improves visibility from the operator platform 7 in the forward direction A. At the same time, the cover wall 19 may also be configured to slope in vertical direction downward in the direction perpendicular to the longitudinal center M of the machine toward its edge region, in which it adjoins the sidewall regions SB1, SB2 and SB3 as well as the inclined surfaces 16 and 17. This sloping configuration toward the sides and/or toward the front is also independent of the specific embodiment example.

What is claimed is:

1. A self-propelled ground milling machine, comprising:

a machine frame;

a drive motor;

a ground milling device with a milling drum arranged inside a milling drum box and rotatable about a horizontal rotation axis extending transversely to a forward direction of the ground milling machine;

front and rear travel devices;

a right and a left lateral outer wall;

an operator platform;

a cover; and wherein at least one of the right and the left lateral outer walls has, in the forward direction toward a front, a first sidewall region arranged in front of the operator platform in the forward direction toward the front, a second sidewall region positioned in front of the first sidewall region in the forward direction toward the front, and a third sidewall region positioned in front of the second sidewall region in the forward direction toward the front, wherein the second sidewall region protrudes sideways in a horizontal direction and perpendicular to the forward direction of the machine relative to the first and third sidewall regions and away from a longitudinal center of the machine extending in the forward direction, wherein, in a vertical direction, a maximum lateral boundary of the machine is defined by at least one of the first, second and third sidewall regions, and/or the front travel device, and wherein the second sidewall region is shorter in the forward direction than the first and/or third sidewall region, wherein the cover provides a top side of the ground milling machine in a region in front of the operator platform in the forward direction, and comprises all cover parts visible in a top view from above the ground milling machine, and any inclined surface(s) of the top side of the ground milling machine and of the cover is/are not of the first, second and third sidewall regions.

2. The ground milling machine according to claim 1, wherein the first and/or the second and/or the third sidewall region are configured essentially planar and/or extend parallel to the vertical direction.

3. The ground milling machine according to claim 1, wherein the first and/or the second and/or the third sidewall region, in a horizontal plane in a direction perpendicular to the longitudinal center of the machine, are each free of projections in the vertical direction.

4. The ground milling machine according to claim 1, wherein:

at least one of the front travel devices is connected to the machine frame via a height-adjustable lifting column, and the second sidewall region and the lifting column are arranged such that, when the second sidewall region and the lifting column are projected into a virtual plane extending in the forward direction and the vertical direction, the lifting column is overlapped by the second sidewall region in the forward direction.

5. The ground milling machine according to claim 4, wherein the second sidewall region and the lifting column are arranged such that, when the second sidewall region and the lifting column are projected into a virtual plane extending in the forward direction and the vertical direction, the lifting column is completely overlapped by the second sidewall region in the forward direction.

6. The ground milling machine according to claim 1, wherein the first and/or the second and/or the third sidewall region are set back toward the longitudinal center of the machine relative to lateral outer boundaries of the operator platform.

7. The ground milling machine according to claim 6, wherein the first and/or the second and/or the third sidewall region are set back toward the longitudinal center of the machine relative to lateral outer boundaries of the operator platform on both sides of the ground milling machine.

8. The ground milling machine according to claim 1, wherein an outer end face of one of the front travel devices protrudes beyond the first and/or the second and/or the third sidewall region as seen perpendicular to a longitudinal direction of the machine.

9. The ground milling machine according to claim 1, wherein the second sidewall region overlaps an outer end face of one of the front travel devices as seen perpendicular to a longitudinal direction of the machine.

10. The ground milling machine according to claim 1, wherein the first and/or the second and/or the third sidewall region extend, in a horizontal plane and perpendicular to the longitudinal center of the machine extending in the forward direction, to a front travel device.

11. The ground milling machine according to claim 1, wherein a transition from the first to the second sidewall region and/or the transition from the second to the third sidewall region is formed by inclined surfaces running at an angle to a longitudinal direction of the machine.

12. The ground milling machine according to claim 11, wherein the inclined surfaces have an extension in the longitudinal direction of the machine which is smaller than an extension of the first and/or second and/or third sidewall region.

13. The ground milling machine according to claim 1, wherein both lateral outer walls in the first and/or second and/or third sidewall region are configured mirror-symmetrical to one another.

14. The ground milling machine according to claim 1, wherein a cover wall is provided which extends from the operator platform in the forward direction toward the front and slopes downward in the forward direction toward the front.

15. The ground milling machine according to claim 14, wherein the cover wall overlying the first and/or the second and/or the third sidewall region slopes downward in the forward direction toward the front and slopes downward sideways in a direction transversely away from the longitudinal center of the machine.

16. The ground milling machine according to claim 1, wherein, in the vertical direction, the maximum lateral boundary of the machine is defined by at least one of the first, second and third sidewall regions.

17. The ground milling machine according to claim 1, wherein, in the vertical direction, the maximum lateral boundary of the machine in the first and/or third sidewall regions is defined by the front travel device.

18. The ground milling machine according to claim 1, wherein the maximum lateral boundary of the machine is determined in a horizontal plane in a direction perpendicular to the longitudinal center of the machine.

19. The ground milling machine according to claim 1, wherein a virtual plane extends in the vertical direction and a direction parallel to the longitudinal center of the machine, and the first and third sidewall regions both occupy the virtual plane.

* * * * *